United States Patent [19]

Foerst

[11] 4,205,584

[45] Jun. 3, 1980

[54] TUNING DEVICE FOR MUSICAL INSTRUMENTS

[75] Inventor: Reiner Foerst, Gummersbach, Fed. Rep. of Germany

[73] Assignee: Dr.-Ing. Reiner Foerst GmbH, Gummersbach, Fed. Rep. of Germany

[21] Appl. No.: 896,762

[22] Filed: Apr. 17, 1978

[30] Foreign Application Priority Data

Apr. 16, 1977 [DE] Fed. Rep. of Germany ..... 2716910

[51] Int. Cl.[2] ..... G10G 7/02

[52] U.S. Cl. ..... 84/454; 84/DIG. 18; 324/79 D

[58] Field of Search ..... 84/454, 455, DIG. 18; 324/78 F, 79 R, 79 D

[56] References Cited

U.S. PATENT DOCUMENTS 3,144,802 8/1964 Faber ..... 84/454

3,948,140 4/1976 Ichioka ..... 84/454

FOREIGN PATENT DOCUMENTS 1213794 11/1970 United Kingdom ..... 84/454

*Primary Examiner*—L. T. Hix

*Assistant Examiner*—S. D. Schreyer

*Attorney, Agent, or Firm*—Becker & Becker, Inc.

[57] ABSTRACT

A tuning device for musical instruments, which includes: harmonic filters for the prevention of zero transits of the tone frequency voltage extraneous to the fundamental tone oscillation or to the second or fourth harmonic, a Schmitt-trigger for the conversion of the filtered tone frequency voltage into a digital oscillation, an oscillation counter with decoder and display means to the input of which the digital oscillation signal together with the reference period signal is fed via an AND-gate and which is reset by the signal for lacking amplitude of the tone frequency voltage, a reference frequency source, a reference period generator, triggering means for triggering the reference period generator, a flip-flop for the generation of an oscillation period signal, and a synchronizing device for synchronizing the beginning of the counting period with the reference frequency voltage.

3 Claims, 1 Drawing Figure

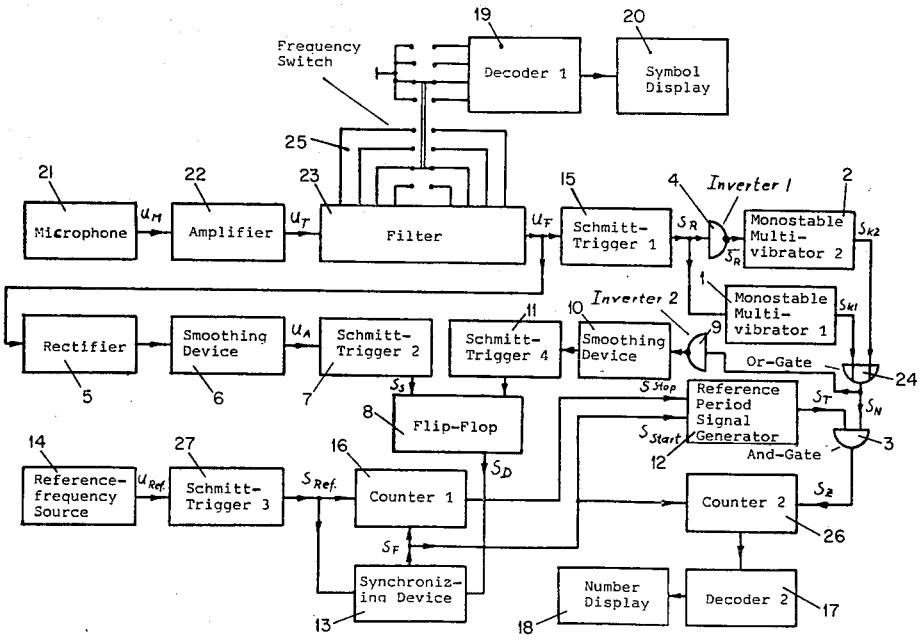

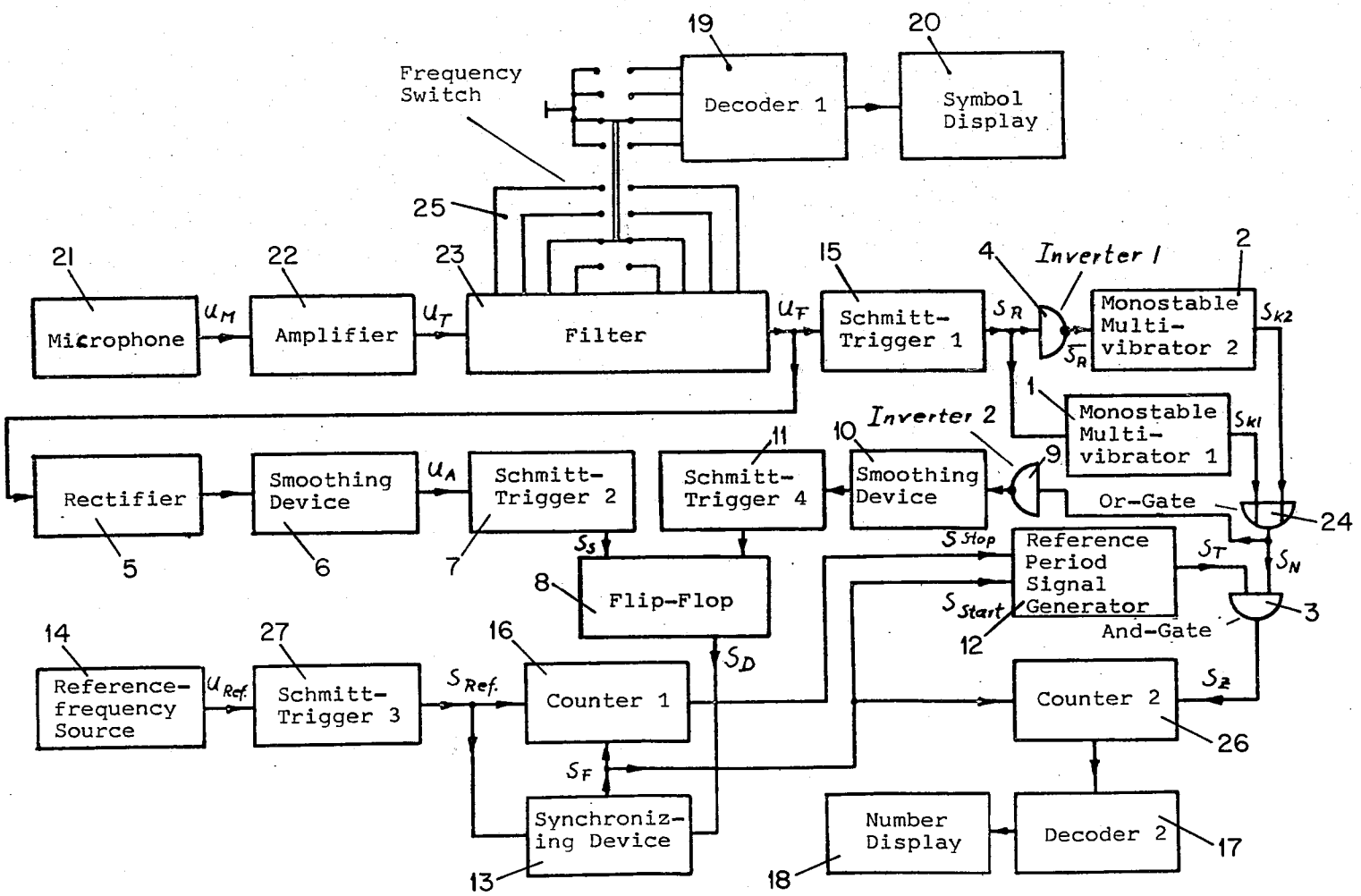
Symbol Display
Decoder 1
Frequency Switch
Filter
Amplifier
Microphone
Schmitt-Trigger 1
Inverter 1
Monostable Multi-vibrator 2
Monostable Multi-vibrator 1
Inverter 2
Smoothing Device
Or-Gate
Schmitt-Trigger 4
Schmitt-Trigger 2
Smoothing Device
Rectifier
Flip-Flop
And-Gate
Reference Period Signal Generator
Counter 2
Decoder 2
Number Display
Counter 1
Synchronizing Device
Schmitt-Trigger 3
Reference-frequency Source

TUNING DEVICE FOR MUSICAL INSTRUMENTS

The present invention relates to a device for tuning musical instruments without using the hearing sense.

Devices for the tuning of musical instruments are known. They use generators for oscillations of definitely preset frequency, to which the tones to be tuned are compared. The frequency difference is measured and can be minimized by tuning the musical instrument. The disadvantages of these known devices are the relatively high expenses, the limitation in their use, the dependency of the display period on the tone oscillation period, and the difficulty of reading their display. Therefore, it is an object of this invention to create a device, which can be designed economically, is accurate, can be used for any instrument, and is pleasant to read and easy to handle.

This object and other objects and advantages of the invention will appear more clearly from the following specification in connection with the accompanying drawing showing by way of a block diagram a device according to the invention.

The number of oscillations of the tone to be tuned is measured according to the invention by counting the zero transits of a tone wave which is sufficiently cleaned from harmonics by specifically tuned filters during a sufficiently accurate preset reference period. The magnitude of this reference period is preferably 1 second. The measured number is displayed optically.

According to the invention, the start of the counting period is triggered when a preset tone volume is exceeded, and the vanishing of the display is triggered, when the oscillation amplitude decreases below the minimum oscillation amplitude necessary for the counting process. By this method of triggering and stopping of the counting and display periods, it is assured that the tone is measured right after its start, once, and error-free. This has the advantage that the tone is measured at high amplitude and that the musician does not have to wait for the measuring result longer than necessary while he will be able to keep the display before his eyes as long or as briefly as he wants to by letting the tone oscillate accordingly.

According to a modification of this invention, with instruments with very brief tone oscillation period, the display is extinguished by hand. In this connection, it must be assured that the oscillation amplitude is sufficiently high during the reference period.

Referring now to the drawing in detail, the output voltage $U_M$ of a microphone 21 or a musical instrument with electrical tone signal is amplified in the amplifier 22 to the tone frequency voltage $U_T$. The tone frequency voltage $U_T$ affected with harmonics is cleaned of its harmonics in a filter 23 with preset frequency limits or resonance frequencies in a way that guarantees only one zero transit per half wave. The frequency limits or resonance frequencies are selected by a multipole switch 25. In the example shown in the drawing, there are four definitely tuned frequency limits or resonance frequencies. The filters may be designed as low-pass-filter of one- or multi-fold grade or as resonance filters. The frequency limits or resonance frequencies are to attach for instance to the fundamental or second harmonic frequencies of the strings of a bass guitar. In the example shown in the drawing, it is provided that besides the switching for the filter frequencies also the symbol of the respective tone is displayed, for instance "A". To this end, a second switching plane on the switch, a decoder 19 and a symbol display component 20 are provided.

The filtered tone frequency voltage $U_F$ is transformed in a Schmitt-trigger 15 into a digital oscillation signal $S_R$. The length of this rectangle is reduced in a monostable multivibrator or a mono-flop 1 to a value which is shorter than the half cycle or period of the maximum frequency to be measured. A second monostable multivibrator or mono-flop 2 generates the short pulse for the other zero transit of the tone frequency voltage using the rectangular oscillation signal $S_R$ inverted in an inverter 4. The two short pulses $S_{K1}$ and $S_{K2}$ appear right after the two zero transits and are added in an OR-gate 24 to the zero transit signal $S_N$.

The filtered tone frequency voltage $U_F$ is used also for another purpose. It is rectified in a rectifier 5 and converted into a smoothed direct voltage signal $U_A$ via a smoothing device 6.

The direct voltage signal $U_A$ is a measure for the amplitude of the tone frequency oscillation, which decreases at string instruments with time. The amplitude voltage $U_A$ is transformed in a Schmitt-trigger 2 into a digital starting signal $S_S$. The threshold of the Schmitt-trigger is so adjusted that the measuring process is started only when the tone frequency voltage $U_F$ has reached an amplitude, which is sufficiently high to supply accurate zero transits during the reference period despite the decreasing. The starting signal $S_S$ sets a flip flop 8 supplying the oscillation period signal $S_D$.

The zero transit signal $S_N$ is used not only as input to the oscillation counter 26 but also for the resetting of the flip flop 8. For this purpose, it is inverted in an inverter 9, smoothed in a smoothing device 10 and supplied to a Schmitt-trigger 11 which resets the flip-flop 8 when the zero transit signal is absent for a period which is longer than the half period of the tone with the minimum frequency to be expected. Instead of the smoothing device also a delay device can be used for this purpose.

The reference frequency source 14 may be an oscillator with sufficiently accurate frequency or the power system. The reference frequency voltage $U_{ref}$ is converted into a digital reference pulse signal $S_{Ref}$ via a Schmitt-trigger 27. The signal $S_{Ref}$ is supplied to the counting input of a reference signal counter 16 and to a synchronizing device 13. Besides, to this synchronizing device 13 also the oscillation period signal $S_D$ from the flip flop 8 is supplied. The synchronizing device 13 supplies a counter enable signal $S_F$ only when the oscillation period signal $S_D$ has appeared and the counting flank of the reference pulse signal appears. At that instant, when the counter enable signal $S_F$ appears, the reference period signal generator 12 is started by the input signal $S_{Start}=S_F$. When the reference signal counter 16 has counted a preset number of pulses, according to the reference period chosen, preferably 1 second, it resets the reference period signal generator via the input signal $S_{Stop}$.

The output $S_T$ of the reference period signal generator is supplied to an AND-gate commonly with the zero transit signal $S_N$. The output $S_T$ of the AND-gate is supplied to the counting input of a multi-digit oscillation counter 26, which is enabled by the counter enable signal $S_F$. The output signals of the counter oscillation 26 are supplied via decoder 17 to a display means 18 which displays finally the number of half periods during the reference period.

Accordingly, the present invention relates to a device for the measurement of the number of cycles or half cycles of a tone during a preset reference time period.

With renunciation of the two monostable multivibrators, the whole periods are counted and the accuracy is reduced to half.

It is, of course, to be understood that the present invention is, by no means, limited to the specific showing in the drawing, but also comprises any modifications within the scope of the appended claims.

What I claim is:

1. In a tuning device for musical instruments the input signals of which are a filtered tone oscillation, a digital oscillation signal, and a reference signal with an input means for the measurement of the number of periods or half-periods of a tone during a present reference time period including a microphone, an amplifier, a filter for the prevention of zero transits extraneous to the fundamental tone oscillation, a Schmitt-trigger for the conversion of the filtered tone frequency voltage into the digital oscillation signal, an AND-gate which is open during a preset reference time, a reference period generator, a reference signal counter, an oscillation counter a decoder and a display means, and a flip-flop for the generation of an oscillation period signal, which is set by a triggering circuit and reset by a resetting circuit and which supplies an enable signal by which the reference period generator is triggered and the two counter are enabled, the improvement in combination therewith for the triggering circuit comprising a rectifier the input of which is an amplitude of the filtered tone oscillation voltage, a first smoothing device, and a first Schmitt-trigger the output of which sets the flip-flop for the generation of an oscillation period signal, and for the resetting circuit fed by the zero transit signal comprising an inverter the input of which is the digital oscillation signal, a second smoothing device, and a second Schmitt-trigger the output of which resets said flip-flop.

2. A device in combination according to claim 1 comprising a synchronizing device which supplies the enable signal after the appearance of the oscillation period signal and simultaneously with the counted flank of the reference signal.

3. A device in combination according to claim 1 comprising a first monoflop and a series circuit of an inverter means and a monoflop to the inputs of which the digital oscillation signal is fed and the outputs of which are added in an OR-gate which supplies a zero transit signal.

* * * * *